US005706726A

United States Patent [19]

Stephan

[11] Patent Number: 5,706,726

[45] Date of Patent: Jan. 13, 1998

[54] DEVICE FOR ACHIEVING A FLAWLESS APPLICATION OF PRINTING STOCK IN A PRINTING PRESS

[75] Inventor: Günter Stephan, Wiesloch-Baiertal, Germany

[73] Assignee: Heidelberger Druckmaschinen AG, Heidelberg, Germany

[21] Appl. No.: 671,799

[22] Filed: Jun. 24, 1996

[30] Foreign Application Priority Data

Jun. 24, 1995 [DE] Germany ..... 195 23 076.0

[51] Int. Cl.[6] ..... B41F 13/24

[52] U.S. Cl. ..... 101/232; 101/230

[58] Field of Search ..... 101/232, 230, 101/142, 141, 419, 416.1

[56] References Cited

U.S. PATENT DOCUMENTS

| | | | |
|---|---|---|---|
| 2,961,952 | 11/1960 | Doyle | 101/416.1 |
| 3,515,064 | 6/1970 | Vlier | 101/424.1 |
| 3,949,671 | 4/1976 | Madigan | 101/232 |
| 4,384,524 | 5/1983 | Simeth et al. | 101/232 |
| 4,449,453 | 5/1984 | Staffer et al. | 101/424.1 |
| 4,512,255 | 4/1985 | Crist | 101/230 |
| 4,869,166 | 9/1989 | Mathes | 101/230 |
| 5,156,090 | 10/1992 | Wirz | 101/142 |
| 5,309,838 | 5/1994 | Kurz | 101/480 |
| 5,398,925 | 3/1995 | Zeltner | 271/276 |
| 5,537,922 | 7/1996 | Becker | 101/230 |

FOREIGN PATENT DOCUMENTS

| | | |
|---|---|---|
| 0 246 100 | 11/1987 | European Pat. Off. . |
| 30 44 649 | 11/1982 | Germany . |
| 40 39 311 | 6/1992 | Germany . |
| 43 18 777 | 12/1994 | Germany . |
| 43 26 835 | 2/1995 | Germany . |
| 59-153124 | 10/1984 | Japan . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A device in a printing press for applying air flow to printing stock being transferred by a transfer drum to an impression cylinder so as to achieve a flawless application of the printing stock on the impression cylinder before the printing stock reaches a printing nip defined by the impression cylinder and a blanket cylinder of the printing press includes a flat air-guide element extending over the breadth of the impression cylinder from a vicinity of the circumference of the transfer drum to as far as possible in a direction towards the printing nip so as to form a wedge-shaped space having a tip extending towards the printing nip.

11 Claims, 5 Drawing Sheets

DEVICE FOR ACHIEVING A FLAWLESS APPLICATION OF PRINTING STOCK IN A PRINTING PRESS

BACKGROUND OF THE INVENTION

Field of the Invention

The invention relates to a device for achieving a flawless application or disposition of printing stock or substrate on an impression cylinder of a printing press before the printing stock reaches a printing nip, by applying an air flow to the printing stock or substrate.

In a printing press, a flawless application or disposition of the printing stock on the impression cylinder, particularly before the printing nip, is required in order to ensure clean and in-register printing. In order to solve this technical problem, the published Japanese Patent Document Sho 59-153124 has proposed providing an air-blast tube formed with two air-outlet openings, one of the openings being immediately before the printing location, and the other of the openings being directed towards the region of the impression cylinder lying therebefore. In this heretofore-known device, compressed air is required in every case for applying air. The application of air is not optimal, because the surface of the printing stock or substrate is not continuously subjected to air. There are impact areas of the compressed air in which the printing stock or substrate is pressed against the impression cylinder; outside these impact areas, however, there are also suction regions wherein the printing stock or substrate threatens to lift off from the impression cylinder, particularly due to the fact that centrifugal force additionally spreads its effect.

SUMMARY OF THE INVENTION

It is accordingly an object of the invention to provide a device for achieving a flawless application or disposition of printing stock in a printing press by optimally applying air to the printing stock on an impression cylinder, particularly immediately before a printing nip.

With the foregoing and other objects in view, there is provided, in accordance with the invention, in a printing press, a device for applying air flow to printing stock being transferred by a transfer drum to an impression cylinder so as to achieve a flawless application of the printing stock on the impression cylinder before the printing stock reaches a printing nip defined by the impression cylinder and a blanket cylinder of the printing press, comprising a flat air-guide element extending over the breadth of the impression cylinder from a vicinity of the circumference of the transfer drum to as far as possible in a direction towards the printing nip so as to form a wedge-shaped space having a tip extending towards the printing nip.

In accordance with another feature of the invention, the flat air-guide element is adjustable into various positions for varying the wedge-shaped space.

In accordance with a further feature of the invention, the device includes two linear guides supporting the air-guide element, and a drive for the linear guides.

In accordance with an added feature of the invention, the linear guides extend so that the flat air-guide element, with a front end thereof directed substantially towards the printing nip, is swivelable and displaceable for widening the wedge-shaped space at a side thereof adjacent the transfer drum.

In accordance with an additional feature of the invention, the device includes a four-bar linkage for adjusting the air-guide element.

In accordance with yet another feature of the invention, the device includes air-blast nozzles carried by the air-guide element at the end thereof directed towards the printing nip for directing an air flow away from the printing nip and towards the impression cylinder.

In accordance with yet a further feature of the invention, the air-blast nozzles are disposed in an arcuate progression across the air-guide element so that the printing stock is initially subjected to blast air in the center thereof.

In accordance with yet an added feature of the invention, the device includes large-area air-blast equipment having a high volumetric flowrate carried by the air-guide element, the large-area blast-air equipment being formed of a plurality of axial-flow fans.

In accordance with yet an additional feature of the invention, the impression cylinder is subjectible to blast air from large-area air-blast equipment up to a sheet-transfer line of the transfer drum.

In accordance with another feature of the invention, the air-guide element carries air-blast nozzles at an end thereof directed towards the printing nip, large-area air-blast equipment in the form of axial-flow fans distal from the end of the air-guide element and a cardboard air-blast section disposed disposed between the end air-blast nozzles and the large-area air-blast equipment, the air-guide element being adjustable between a position thereof closer to the printing nip and the impression cylinder, for applying blast air to paper, to a position thereof more remote from the printing nip and the impression cylinder, for applying blast air to cardboard.

In accordance with a concomitant feature of the invention, the cardboard air-blast section is formed of cardboard air-blast nozzles disposed in a central region of the air-guide element for directing blast air towards the impression cylinder substantially perpendicularly in the printing-press center and, outwardly from the center, increasingly more inclined.

The operating principle of the device according to the invention is that the entrained flow of the transfer cylinder is deflected by the air-guide element and, in the wedge-shaped space, there is a continuous increase in pressure as far as the printing nip.

An advantage of the invention is that the entrained flow is used to apply air to the printing substrate or stock. Such an application of air is optimal, because there are no zonal differences. The force is generated at the site without external energy, it being possible, of course, to employ external energy as a supplement. The complete prevention or, at least, reduction in the use of compressed air results in a saving of energy, which leads to a reduction in operating costs, because less compressed air is required to be made available on the printing press.

Other advantageous embodiments and further developments are available for serving, in particular, to ensure that the printing press can be adapted to many different printing substrates or stocks.

Thus, a further development provides that the flat air-guide element is adjustable into various positions in order to change the wedge-shaped space. Advantageously, stepless adjustment is possible with simultaneous swiveling of the air-guide element. In this manner, the device according to the invention can be adapted to various printing substrates or stocks because, depending upon the position of the air-guide element, air is applied with a different air-pressure profile over the subjected region.

An advantageous further development provides that the air-guide element be supported by two lineal guides and be provided with a drive. Advantageously, the linear guides extend in such a manner that the flat air-guide element, directed with a front end thereof substantially towards the printing nip, is swivelable and displaceable in such a manner that the wedge-shaped space widens at the transfer-drum side thereof. The drive may be a drive link which adjusts the position of the air-guide element through the intermediary of a coupler. It is, however, also possible to adjust the position of the air-guide element by a four-bar linkage.

An important further development of the subject matter of the invention is that additional blast-air elements are provided in order, in this manner, also to be able to handle problematic papers by means of a stronger application of air. For example, the air-guide element may be furnished, at the end thereof directed towards the printing nip, with air-blast nozzles, the air flow therefrom being directed away from the printing nip and towards the impression cylinder. The advantage of this embodiment over the initially mentioned prior art is that the combination of an air-guide element with air-blast equipment provides that the air is not applied in a defined impact area, but that the wedge-shaped space ensures the elimination of the zonal differences in the application of air as well as that there is an optimal air-pressure profile over the subjected region. Furthermore, the subjection of the printing substrate or stock to blast air directed away from the printing nip ensures that the printing substrate or stock is smoothened. Such an alignment of the air flow is necessary, particularly at the ends of the printing substrate or stock, in order to ensure that no air is blown under the end of the printing substrate or stock. This is a danger with the subject matter of the initially cited prior art, wherein the air flow is directed also in the direction of the printing nip.

An additional smoothening effect can be achieved by disposing the air-blast nozzles in such an arcuate progression that a printing substrate or stock is first subjected to blast air in the center. In this manner, the printing substrate or stock is smoothened from the center to the edge thereof, and it is impossible for any air inclusions to remain which would have a negative effect on the printed result.

In addition, it is advantageous to furnish the air-guide element with large-area air-blast equipment having a high volumetric flowrate. Such large-area air-blast equipment achieves good contact of the printing substrate or stock well before the printing nip, which is of advantage particularly in the case of easily bendable papers. Advantageously, the large-area air-blast equipment comprises a number of axial-flow fans, which offer the advantage that the applied air is produced directly on site and there is no loss of energy through losses in supply. An advantageous application of air is achieved in that the large-area air-blast equipment blows air onto the impression cylinder up to the sheet-transfer line of the transfer drum and, where appropriate, also beyond this line.

With these further developments, it is possible to adjust the device according to the invention for all possible papers, even to the thinnest and most unstable of papers. Particularly, in the case of such thin papers, there is no premature, undesirable contact of the rubber-covered cylinder. It is also possible, in this manner, to prevent a sheet from lifting off from the impression cylinder as a result of the effect of centrifugal force. Likewise, it is possible to master problems which occur at high press speeds with unstable papers, such as an uneven, skewed or undulating contact of the sheet on the impression cylinder caused by a lack of inherent stiffness. It is also possible to prevent oscillations of the sheet, such as caused by beating or fluttering, particularly towards the end of the sheet.

Because the printing press, however, is required to be as universally applicable as possible, a further development provides that the air-guide element be furnished with an additional cardboard air-blast section which is disposed in such a manner that a strong application of blast air is possible at a distance from the printing nip. In contrast with thin printing substrates, particularly unstable papers, cardboard requires considerably different handling. The strong application of air at a distance from the printing nip produces a lever effect which presses cardboard onto the impression cylinder as a result of the inherent stiffness of the cardboard.

Advantageously, the cardboard air-blast section is disposed between the blast-air nozzles and the large-area air-blast equipment, the air-guide element being adjusted, for air-blast application to cardboard, to a position wherein the air-guide element is moved farther away from the printing nip and from the impression cylinder than when it is to be used for air-blast application to paper. It is possible, in this manner, for the cardboard air-blast section to be advantageously accommodated in the air-guide element and for the ideal positioning of the cardboard air-blast section to be achieved in that the air-guide element is adjusted in position. Furthermore, such an adjustment in position enlarges the wedge-shaped space, and a collision with the air-guide element by a raised end of the printing substrate or stock, due to the inherent stiffness of the cardboard, is prevented.

A further advantageous embodiment provides for the cardboard air-blast section to be formed of cardboard air-blast nozzles disposed in the central region of the air-guide element, the cardboard-blast-air nozzles blasting air towards the impression cylinder, relatively perpendicularly in the center thereof and, outwardly from the center thereof, increasingly more diagonally or outwardly inclined. A consequence of this arrangement is that, irrespective of the width of a stock cardboard, it is not possible for air to be blown underneath the cardboard at the edges thereof, but rather, the cardboard is in good contact over the entire breadth thereof, regardless of whether the cardboard is of a minimum or maximum size or format. In this manner, no adjustment of the cardboard air-blast section for a specific size or format of cardboard is required.

Other features which are considered as characteristic for the invention are set forth in the appended claims.

Although the invention is illustrated and described herein as embodied in a device for achieving a flawless application of printing stock in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
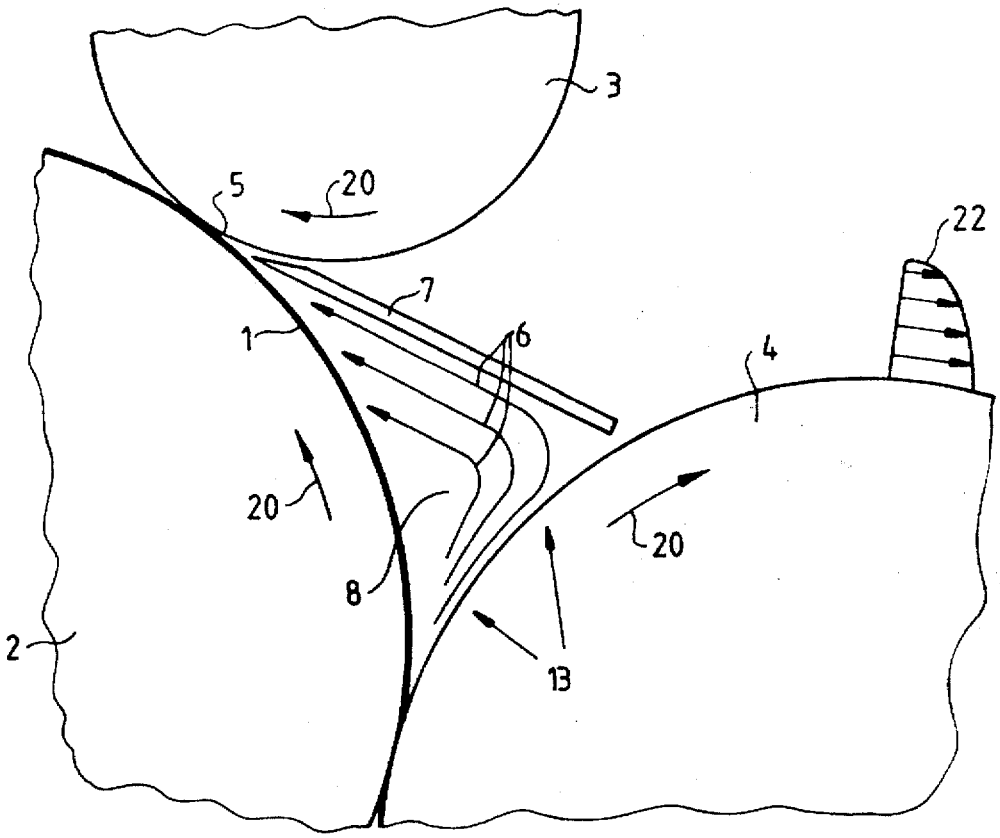
FIG. 1 is a sketch representing a fragmentary, diagrammatic and schematic side elevational view, partly broken away, of a symbolically illustrated device according to the invention.

Referring now to the drawing and, first, particularly to FIG. 1 thereof, there is shown therein a basic sketch of the device according to the invention. The sketch of FIG. 1 shows respective parts of a rubber-covered cylinder 3, an impression cylinder 2 and a transfer drum 4 in the vicinity of the device according to the invention. The rubber-covered cylinder 3, the impression cylinder 2 and the transfer drum 4 define a chamber or space which is bounded on three sides and is open on the fourth side. An air-guide element 7 is disposed in this chamber or space so that it extends from the vicinity of the circumference of the transfer drum 4 to as far as possible in a direction towards a printing nip 5 between the impression cylinder 2 and the rubber-covered cylinder 3. This forms a wedge-shaped space 8, a tip of which extends to the printing nip 5. All of the rotating drums and cylinders form an entraining flow thereabout having a speed profile 22 represented, by way of example, on the transfer drum 4. The entraining flow 22 is deflected by the air-guide element 7 and is directed in the wedge-shaped space 8 towards the printing nip 5 and the impression cylinder 2, with an increase or buildup in pressure due to the constriction or narrowing. This produces an air flow 6 which is applied to the printing stock 1 in a manner that the printing stock 1 is pressed, with increasing force, in a direction towards the printing nip 5, against the surface of the impression cylinder 2.

Figure 2:
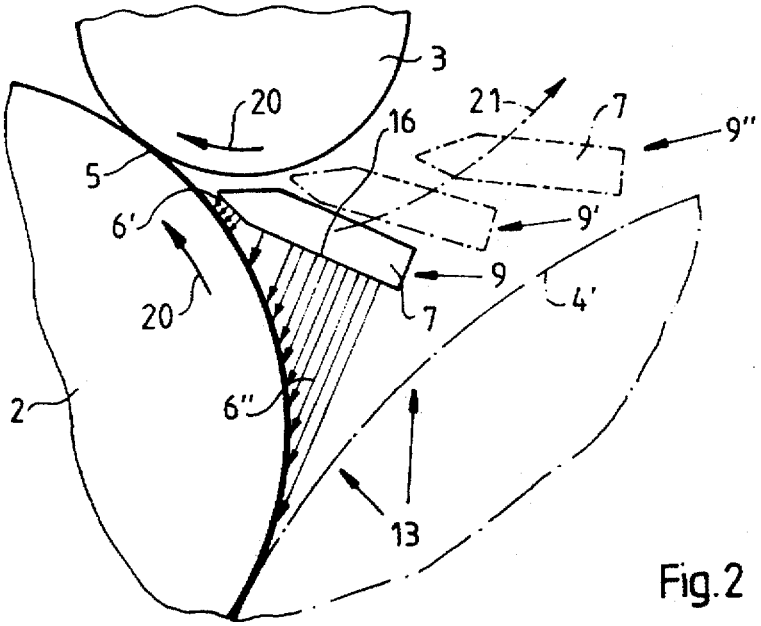
FIG. 2 is a view like that of FIG. 1 of another symbolically illustrated embodiment of the invention showing various possibilities for positional adjustment and additional air-blast application.

FIG. 2 shows an embodiment wherein the air-guide element 7 is adjustable in position as represented by the arrow 21 shown in phantom. This positional adjustment may be effected steplessly or infinitely and may be associated with a swiveling motion. Examples of the various positions of the air-guide element 7 are shown in solid lines at 9, and in phantom at 9' and 9". In the positions of the air-guide element 7 at 9 and 9', the printing stock 1 is subjected to an application of air thereto. In the position 9", the air-guide element 7 has been placed out of operation. In FIG. 2, the air-guide element 7 is diagrammatically shown as being provided with equipment for producing an additional air flow 6' directed away from the printing nip 5 and towards the impression cylinder 2, the equipment being situated at that end of the air-guide element 7 which is as close as possible to the printing nip 5. Such equipment serves for effecting an additional increase in pressure in the critical region before the printing nip 5, in order, in this manner, also to be able to supply very unstable papers to the printing nip 5 with good contacting engagement thereof on and with the impression cylinder 2. In addition, a large-area air-blast device 16 may be provided which applies an air flow at a high volumetric flow rate to the region of the printing stock or substrate 1 farther removed from the printing nip 5. In this manner, the device according to the invention is able to be adjusted to a multiplicity of different printing stocks or substrates 1. Such an adjustment occurs both as a result of the selection of the position of the air-guide element 7, as well as due to whether one or both additional air-blast devices are switched on.

Figure 3:
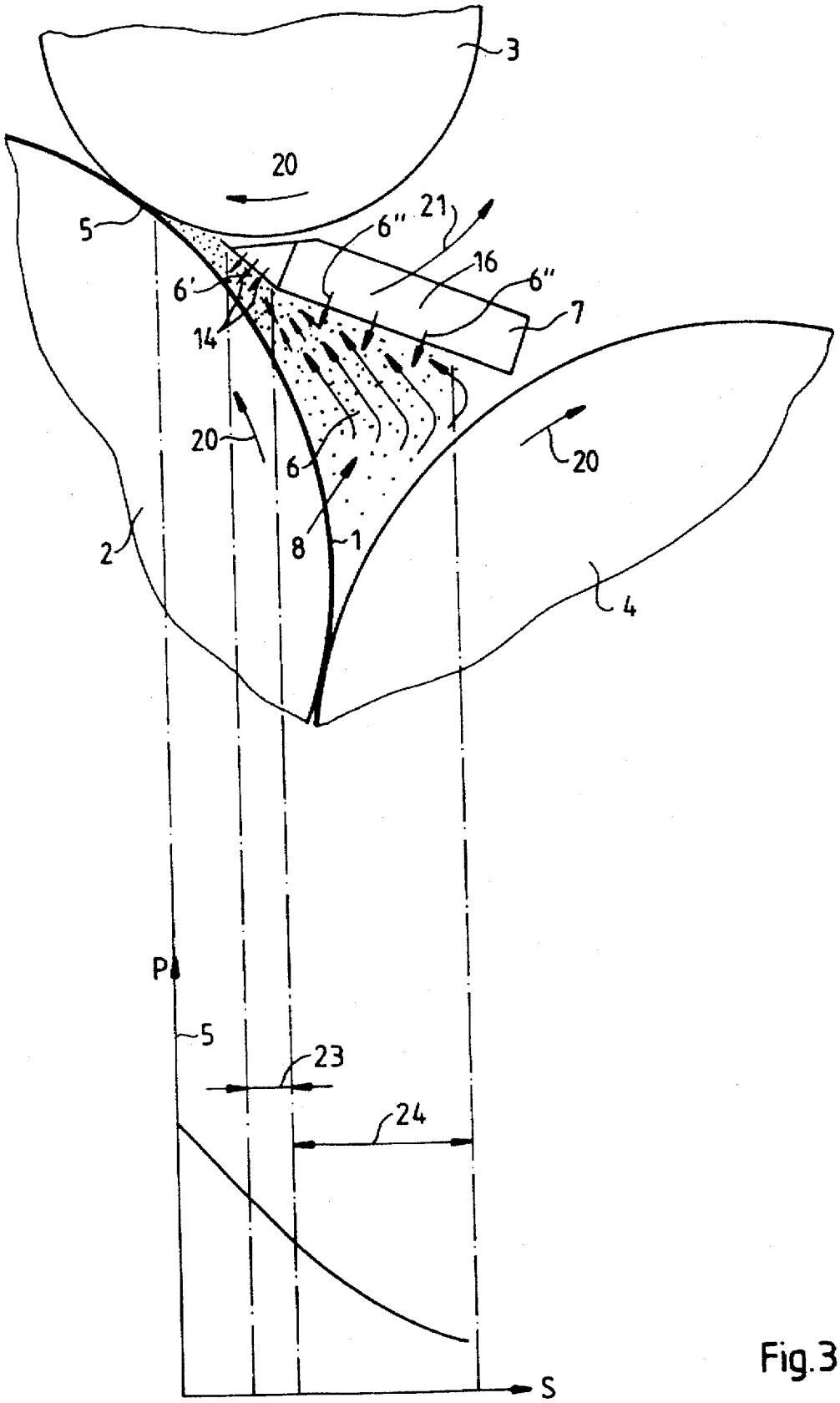
FIG. 3 is yet another view like those of FIGS. 1 and 2 of a further symbolically illustrated embodiment of the invention with a graphic display of the operation thereof.

FIG. 3 serves to illustrate the operating principle of the device according to the invention. The parts shown therein correspond to those previously illustrated in FIG. 2, the buildup of pressure in the wedge-shaped space 8 being symbolized by a multiplicity of dots. This buildup of pressure occurs in the manner described hereinbefore with reference to FIG. 1. Further presented in FIG. 3 is a graph showing the profile of the air pressure p in the corresponding regions. The deflected entrained flow at the transfer drum 4 having the velocity profile 22 (note FIG. 1) cooperates with the additional air introduction or application at 6' and 6" through the blast-air nozzles 14 and the large-area blast-air device 16, respectively, with the result that the air flow 6 is reinforced by the air flows 6" and 6'. The additional air flow 6' takes place in a region 23 which is as close as possible to the printing nip 5. The air flow 6" occurs in a region 24 located upstream thereof, as viewed in the overall airflow direction. The thus generated, reinforced pressure buildup makes it possible to supply even extremely unstable papers to the printing nip 5 with flawless contact on and with the impression cylinder 2.

Figure 4:
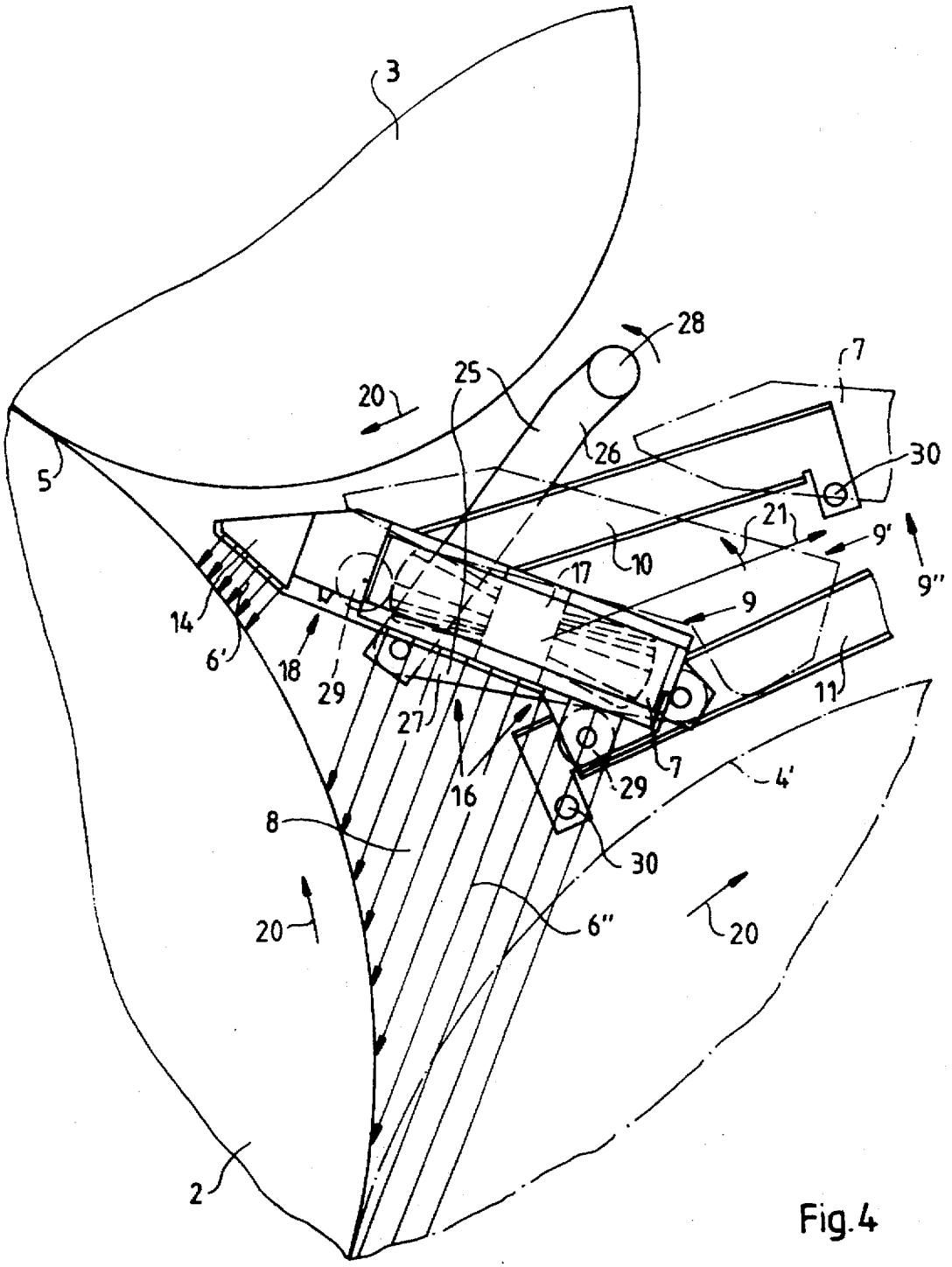
FIG. 4 is an enlarged view of FIG. 3 illustrating the structure of an embodiment of the invention.

FIG. 4 shows an actual physical embodiment of the hitherto diagrammatically represented device according to the invention. The air-guide element 7 contains three air-blast devices, of which one device is situated in the tapered end of the air-guide element 7, the design of the latter thereby assuring that it can be brought as closely as possible to the printing nip 5. Adjacent to the tapered end is a cardboard air-blast member 18, which is followed by the large-area air-blast device 16 in the form of axial blowers or fans 17. The air-guide element 7 is supported by rollers 29 in linear guides 10 and 11. Displacement of the air-guide element 7 on the linear guides 10 and 11 is effected by a drive 28 which is articulatingly connected to one of the rollers 29 through the intermediary of a drive link 26 and a coupler 27. The fact that the two linear guides 10 and 11 are disposed in such a manner that they converge as they extend increasingly distant from the impression cylinder 2 results in the displacement of the air-guide element 7 being associated with a simultaneous swiveling motion, as was shown hereinbefore in FIG. 2. The air-guide element 7 extends in effect over the width of the cylinders 2, 3 and 4, the linear guides 10 and 11, respectively, being affixed by suitable mounting elements 30 to the inner sides of the side walls of the printing press. The transfer drum 4 need not be in the form of a closed drum, but may possibly also be formed as any other suitable rotating element carrying grippers 31 which revolve along a travel path 4'. With the transfer drum 4 of such a construction, for example, formed as a triangular column, the existing entrained flow is increased and thereby achieves a greater buildup of pressure in the wedge-shaped space 8.

Figure 5:
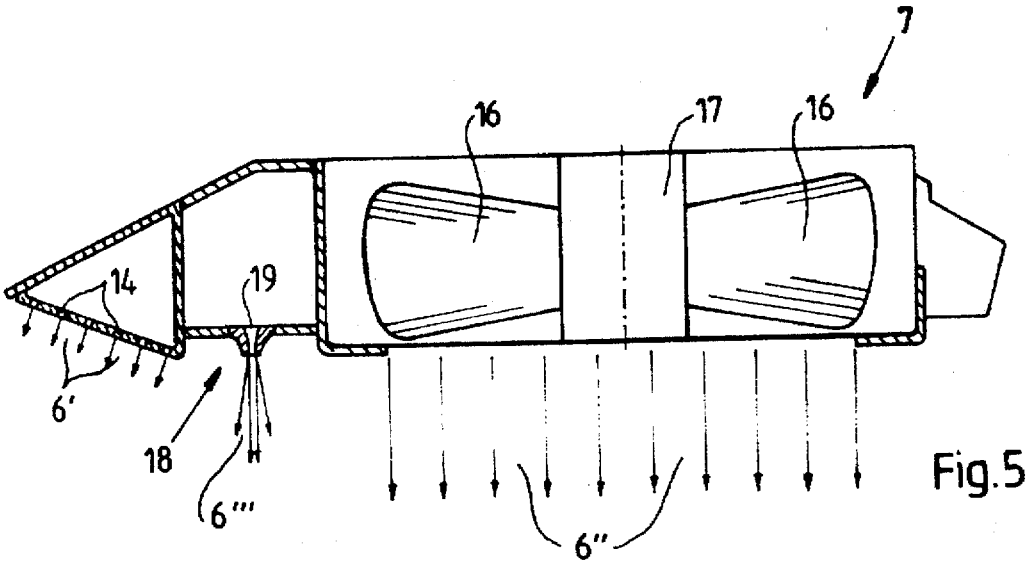
FIG. 5 is a fragmentary view of FIG. 4 showing in section an air-guide element forming part of the device according to the invention.

FIG. 5 is a longitudinal sectional view of the air-guide element 7. Located at the tip thereof are the blast-air nozzles 14 for generating the air flow 6'. Next thereto is the cardboard air-blast member 18 provided with the cardboard air-blast nozzles 19, which generate a tightly bundled or focused air flow 6"'. Adjacent thereto is the large-area air-blast device 16, which is formed of axial-flow blowers or fans 17 so as to generate the flow 6' which has a high volumetric flow rate.

Figure 6:
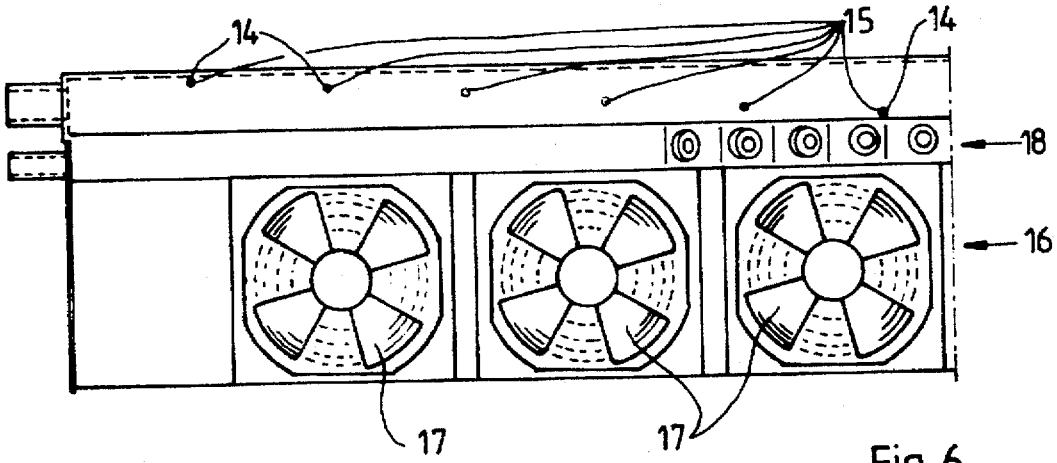
FIG. 6 is a fragmentary bottom plan view of FIG. 5 rotated horizontally clockwise through an angle of 90 degrees.

FIG. 6 is a further fragmentary top plan view of the air-guide element 7 of FIG. 5, showing the air-blast devices 14, 18, 16. Only half of the air-guide element 7 extending from the printing-press center to the side wall is illustrated in FIG. 6, because the other half thereof is precisely symmetrical in appearance. This view shows the air-blast nozzles 14 disposed in an arcuate progression 15, the supplementation thereof by the other half being left to the imagination. Due to this arrangement, the air flow 6' initially strikes the center of the sheet and then moves outwardly, thereby achieving a smoothening of an unstable paper. Then, the cardboard air-blast members 18 are disposed adjacent the progression of air-blast nozzles 14 and are used only for the applying air to cardboard or pasteboard. The cardboard air-blast members 18 are described in greater detail hereinbelow. The largest surface area of the air-guide element 7 is taken up by the large-area air-blast device 16 which is formed of axial-flow blowers or fans 17 and serves to ensure a good contact of a printing substrate or stock 1 following transfer thereof from the transfer drum 4 to the impression cylinder 2, until the higher pressure buildup comes into effect just before or in front of the printing nip 5.

Figure 7:
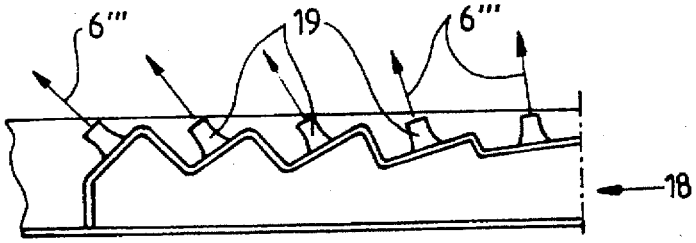
FIG. 7 is a fragmentary sectional view of FIG. 6 showing details of a blast-air nozzle component of the device according to the invention.

FIG. 7 shows an arrangement of the cardboard air-blast member 18 wherein the nozzles 19 are disposed only in the central region of the cardboard format, so that, in the center, the cardboard air-blast nozzles 19 strike the impression cylinder 2 relatively perpendicularly and, towards the edge of the format, are increasingly aligned towards the side. Assurance is thereby provided that all formats or sizes of cardboard, from the smallest to the largest format or size, can be processed, without permitting air to be blown underneath the edges. Pressure application is directed from the center towards the side, thereby additionally serving to ensure a better contact between the cardboard and the impression cylinder 2.

Figure 8:
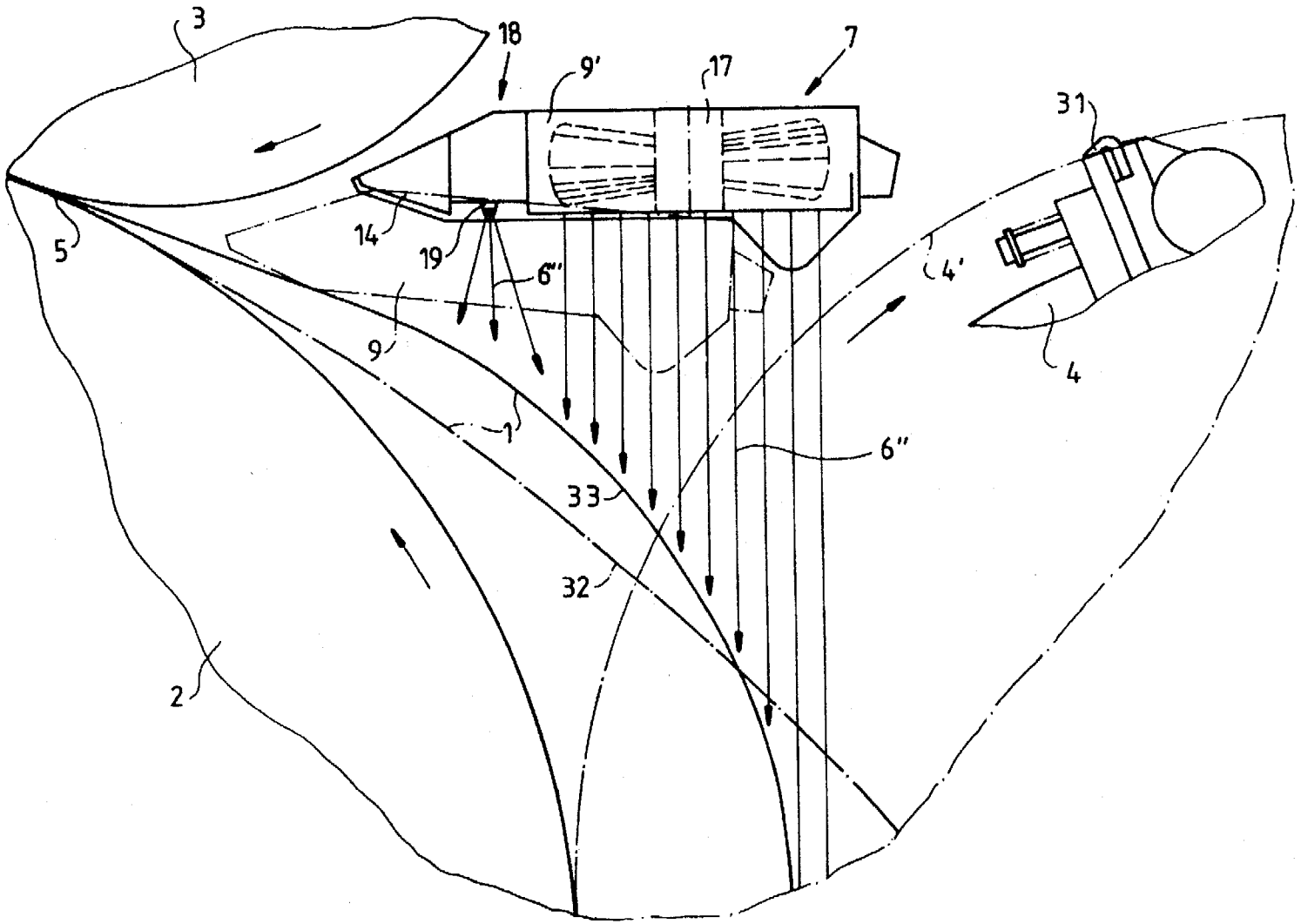
FIG. 8 is a side elevational view of the embodiment according to the invention in an operating phase thereof wherein air is being applied to cardboard.

FIG. 8 shows the air-guide element 7 with air being applied to a stock cardboard. A printing substrate 1 which, when in the form of cardboard or pasteboard, is relatively stiff assumes a position situated between the dot-dash or phantom line 32 and the solid continuous line 33. The reference character 32 represents the static behavior of a cardboard when the printing press is operating very slowly, and the reference character 33 represents the dynamic behavior of the cardboard at a high press speed at which there is somewhat of a thrust from the end of the cardboard sheet. The impact of the strong air flow 6" from the cardboard air-blast nozzles 19 produces a lever effect which, due to the stiffness of the cardboard, results in the achievement of good contact in the region of the impression cylinder 2 before the printing nip 5. For this purpose, the air-guide element 7 is brought into the position 9' thereof, shown in solid lines, so that this lever effect can be achieved. In order to prevent the end of the stiff cardboard from springing back, it is also advantageous to operate the fans 17 so that the air flow 6" counteracts such a spring-back.

The printing press, of course, may also be operated without the use of the air-guide element 7, in which case the air-guide element 7 is brought into the position 9" shown in FIG. 2. In this case, the air-guide element 7 is situated outside the area in which a possible collision with a cardboard might occur, namely where the end of the cardboard, due to the stiffness of the latter, may strike or thrust outwardly. The transfer drum 4 may be of such construction that grippers 31 carried thereby move on an outer travel path represented by a dot-dash or phantom circular line 4', the intermediate region of the travel path 4' and the drum surface 4 being otherwise vacant. As mentioned hereinbefore, this does not oppose the formation of an entrained flow 22, but rather, the strength of the entrained flow 22 is reinforced.

I claim:

1. In a printing press having a device for applying air flow to printing stock being transferred by a transfer drum to an impression cylinder so as to achieve a flawless application of the printing stock on the impression cylinder before the printing stock reaches a printing nip defined by the impression cylinder and a blanket cylinder of the printing press, the improvement comprising a flat air-guide element for deflecting air flow produced by the rotary movement of the impression cylinder and the transfer drum to achieve said flawless application of printing stock on the impression cylinder, said flat air-guide element extending over the breadth of the impression cylinder and from adjacent the transfer drum to adjacent the printing nip so as to form a wedge-shaped space defined by the flat-air guide element, the impression cylinder and the transfer drum, said wedge shaped space having a tip extending towards the printing nip.

2. Device according to claim 1, wherein said flat air-guide element is adjustable into various positions for varying said wedge-shaped space.

3. Device according to claim 2, including two linear guides supporting said air-guide element, and a drive for said linear guides.

4. Device according to claim 3, wherein said flat air-guide element has a front end and said linear guides extend so that said flat air-guide element, with said front end thereof directed substantially towards the printing nip, is swivelable and displaceable along said two linear guides for widening said wedge-shaped space at a side thereof adjacent the transfer drum.

5. Device according to claim 2, including a four-bar linkage for adjusting said air-guide element.

6. Device according to claim 4, including air-blast nozzles carried by said air-guide element at said front end thereof directed towards said printing nip for directing an air flow away from the printing nip and towards the impression cylinder.

7. Device according to claim 6, wherein said air-blast nozzles are disposed in an arcuate progression across said air-guide element so that the printing stock is initially subjected to blast air in the center thereof.

8. Device according to claim 1, including air-blast equipment having a high volumetric flowrate carried by said air-guide element, the blast-air equipment being formed of a plurality of axial-flow fans.

9. Device according to claim 8, wherein the impression cylinder is subjectible to blast air from said air-blast equipment up to a sheet-transfer line of the transfer drum.

10. Device according to claim 1, wherein said air-guide element has an end and carries air-blast nozzles at said end thereof directed towards said printing nip, air-blast equipment in the form of axial-flow fans distal from said end of said air-guide element and an air-blast section disposed between said air-blast nozzles and said air-blast equipment, and including a support for said air-guide element allowing said air-guide element to be adjusted between a position thereof closer to said printing nip and the impression cylinder, for applying blast air to paper, to a position thereof more remote from said printing nip and the impression cylinder, for applying blast air to cardboard.

11. Device according to claim 10, wherein said air-blast section is formed of cardboard air-blast nozzles disposed in a central region of said air-guide element for directing blast air towards the impression cylinder substantially perpendicularly in the printing-press center and, outwardly from the center, increasingly more inclined.

* * * * *